US005086724A

United States Patent [19]

Schreiber

[11] Patent Number: 5,086,724

[45] Date of Patent: Feb. 11, 1992

[54] ANCHOR APPARATUS

[76] Inventor: Ralph E. Schreiber, 9318 W. Missouri, Glendale, Ariz. 85305

[21] Appl. No.: 601,509

[22] Filed: Oct. 22, 1990

[51] Int. Cl.[5] ..... B63B 21/34

[52] U.S. Cl. ..... 114/301

[58] Field of Search ..... 114/293, 294, 295, 296, 114/297, 298, 299, 300, 301, 302, 303, 304, 305, 306, 307, 308, 309

[56] References Cited

U.S. PATENT DOCUMENTS

| | | | |
|---|---|---|---|
| 2,161,906 | 6/1939 | Filby | 114/301 |
| 2,681,631 | 6/1954 | Brewer | 114/301 |
| 2,743,695 | 5/1956 | Bowman | 114/301 |
| 3,026,840 | 3/1962 | Bevers . | |
| 3,269,348 | 8/1966 | Churchward | 114/310 |
| 3,777,695 | 12/1973 | Bruce | 114/301 |
| 3,782,318 | 1/1974 | Hungerford | 114/301 |
| 4,263,867 | 4/1981 | Holmes . | |
| 4,679,348 | 7/1987 | Wimberley | 114/301 |
| 4,802,434 | 2/1989 | Bruce | 114/301 |
| 4,827,863 | 5/1989 | Scholz et al. | 114/301 |

*Primary Examiner*—Jesûs D. Sotelo
*Assistant Examiner*—Stephen P. Avila

[57] ABSTRACT

Anchor apparatus for use in various seabed conditions includes a fluke to which is secured a pair of shanks, a main shank and a retrieval shank, and a wedge having a cutting edge is secured between the fluke and the main shank. A burying plate with cutting edges is removably secured to the fluke. At the outer edge of the burying plate, remote from the fluke, there is a float to help insure that the anchor apparatus remains in an upward or predetermined orientation as it moves downwardly through the water and sets in the seabed. A handle may be secured to the burying plate to help in the manual operation of the anchor apparatus or in the movement of the burying plate as it is removed from the fluke. The anchor apparatus includes two shanks, a main shank and a retrieval shank. Anchor line or chain is secured to the retrieval shank.

17 Claims, 1 Drawing Sheet

ANCHOR APPARATUS

BACKGROUND OF THE INVENTION

1: Field of Invention

This invention relates to anchors and, more particularly, to anchors usable in all types of sea bottoms, including seaweed conditions and rock or coral bottoms.

2Description of the Prior Art

Anchors are used to moor or secure a vessel to the sea bed beneath the vessel. Anchors use a combination of weight and configuration to secure the vessel to the seabed. Thus, in addition to the weight of the anchor itself, the configuration of the anchor is designed to secure itself to the sea bottom, or to rocks, coral, etc., on the sea bottom.

Design limitations generally restrict the use of anchors according to sea bottom conditions. For example, heavy, opposing, dual arm type anchors have been used in seaweed conditions and on rock or coral bottoms. However, such anchors are less than effective in sand and mud conditions.

Danforth type anchors are generally effective in sand and mud bottoms, but they are relative ineffective in seaweed, rock, gravel, and coral bottoms.

Regardless of the particular configuration of an anchor, anchors generally have common elements, but the elements may be configured differently and they may be assembled in different manners. For example, an anchor includes a shank and one or more flukes. In some anchors, the flukes are secured on the outer ends of arms, and the shank is secured to the center of or between the arms.

Anchors typically also include a stock. Usually, the stock is generally perpendicular to the shank and remote from the arms and the flukes. However, in the Danforth type of anchor, the stock is adjacent to the flukes, and the shank is accordingly secured to the stock at the area of the fluke.

Some anchors do not use stocks. For example, anchors used on most relative large, contemporary ships do not use stocks. Such anchors include relatively large flukes that generally pivot from a central position as contact with the seabed is made. The flukes typically pivot in the direction of the pull on the anchor by the vessel, and the flukes then dig into the seabed.

U.S. Pat. No. 3,026,840 (Bevers) discloses an anchor of the Danforth type and utilizing a pair of pivoting flukes. A shank is secured between the flukes. The shank is a generally elongated U-shaped bar secured to a sleeve which pivots on a spindle joining the two flukes. An anchor chain is movable on the shank, and the use of the movable chain on the shank allows the relatively easy retrieval of the anchor from the seabed.

U.S. Pat. No. 3,782,318 (Hungerford) discloses another Danforth type anchor which utilizes cutting edges on a pair of closely adjacent flukes for cutting through seaweed, and the like, in order to penetrate to the bottom. The shank extends at an acute angle with respect to the plane of the flukes. A stock extends generally parallel to the plane of the flukes, and the shank is secured to the flukes adjacent to the stock. The stock is remote from the tips of the flukes.

U.S. Pat. No. 4,263,867 (Holmes) discloses a twin fluke type Danforth anchor in which the shank is somewhat similar to that of the Bevers '840 patent, discussed above. However, the shank in the Holmes patent is referred to as a hairpin shank and the arms of the hairpin are not parallel to each other.

The shanks of both the Bevers '840 patent and the Holmes '867 patent have an inherent problem, namely the fact that the shank elements tend to bend when substantial side pressures are placed on the anchor, as when the anchor is forced to turn to reset itself in the seabed.

U.S. Pat. No. 4,802,434 (Bruce) discloses an anchor with a shank connected directly to a main fluke in a generally "L" configuration. The main fluke includes two spaced apart toes, and there are auxiliary flukes extending outwardly from the main fluke and at angular orientations with respect to the main fluke. One of the primary benefits claimed for the Bruce '434 apparatus is that when the anchor lies inverted on a firm seabed, one of the auxiliary flukes will be in position for digging into the seabed when the anchor is pulled forwardly.

U.S. Pat. No. 4,827,863 (Scholz et al) discloses an anchor having a shank which pivots laterally with respect to a pair of flukes. The flukes are secured together at a mid point and extend downwardly and away from each other. The flukes come together at a central point or link, and the shank extends outwardly and forwardly above the flukes. The Scholz et al '863 apparatus is referred to as a plow anchor, designed to plow into the seabed.

As indicated above, the Danforth type anchors, or plow anchors, are relative effective in sand and mud bottoms, but are relatively ineffective in seaweed, rock, gravel, and coral bottoms. Moreover, extreme angular load conditions, such as imposed by rock or coral bottoms, cause problems with the Danforth type anchors. Likewise, seaweed and loose impediments also render such anchors relative ineffective, and in some cases even useless, until retrieved and cleaned.

SUMMARY OF THE INVENTION

The invention described and claimed herein comprises an anchor having a generally triangularly shaped fluke, a front point, on the fluke, a wedge extending upwardly from the fluke adjacent to the front point, a shank secured to both the fluke and the wedge and extending at an acute angle with respect to the fluke, and a burying plate secured to the fluke. The burying plate is removably secured to the fluke for storage purposes. The burying plate is illustrated in two configurations. One configuration is generally planar, and the second configuration includes a planar portion and a curved portion. The shank includes two portions, a main shank portion and a retrieval shank portion secured to the main shank and extending generally parallel to it. A float is secured to the burying plate remote from the fluke. The purpose of the float is to insure that the anchor lands upright and remains in an upright position when the anchor enters weed beds and that the anchor remains upright during normal dropping and setting actions of the anchors. A handle is also secured to the burying plate to aid in the manual movement of the anchor and of the burying plate. The burying plate is secured to the fluke by a stock extending through a pair of retainers. A pair of removable pins secures the stock in the retainers.

Among the objects of the present invention are the following:

To provide new and useful anchor apparatus;

To provide new and useful anchor apparatus having a fluke, a burying plate secured to the fluke, a shank secured to the fluke, and an wedge secured to both the fluke and shank;

To provide new and useful anchor apparatus having a pair of shanks, including a main shank and a retrieval shank disposed generally parallel to the main shank;

To provide new and useful anchor apparatus usable in various types of sea bottoms;

To provide new and useful anchor apparatus having a burying plate secured to a fluke, and a float secured to the burying plate;

To provide new and useful anchor apparatus having a burying plate removably secured to a fluke;

To provide new and useful anchor apparatus having a shank secured to a fluke, and a burying plate removably secured to the fluke;

To provide new and useful anchor apparatus having a pair of shanks secured to a fluke;

To provide new and useful anchor apparatus having a wedge secured to a fluke and a shank secured to both the wedge and the fluke; and To provide new and useful anchor apparatus having a fluke and a burying plate secured together, a shank secured to the fluke, and a wedge extending between the fluke and the shank for cutting through seaweed and rock.

DESCRIPTION OF THE PREFERRED EMBODIMENT

Figure 1:
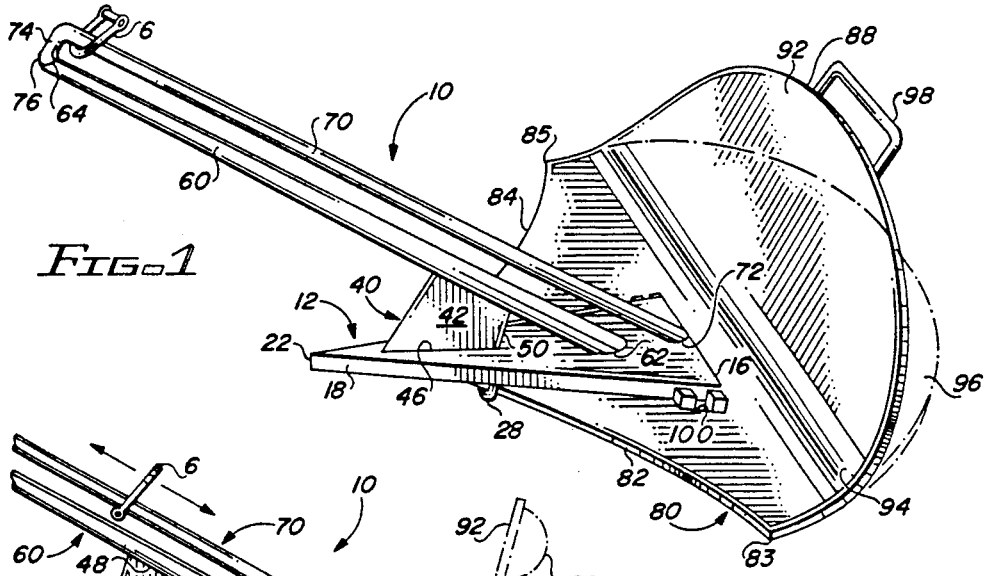
FIG. 1 is a perspective view of anchor apparatus of the present invention.

FIG. 1 is a perspective view of anchor apparatus 10. The anchor apparatus 10 includes a fluke 12, a wedge 40 secured to the fluke 12 and extending upwardly therefrom, a main shank 60 secured to both the fluke 12 and the wedge 40, and a retrieval shank 70 secured to main shank 60 and also to the fluke 12.

The fluke 12 is generally of a triangular configuration. The fluke 12 includes a front point 22, and the wedge 40 is secured to the fluke adjacent to the front point 22. The wedge 40 extends for a relatively short distance along the longitudinal midline or axis of the fluke 12. The shanks 60 and 70 extend at an acute angle to the fluke 12 and over and outwardly from the fluke 12 above the point 22. A burying plate 80 is removably secured to the fluke 12.

Figure 2:
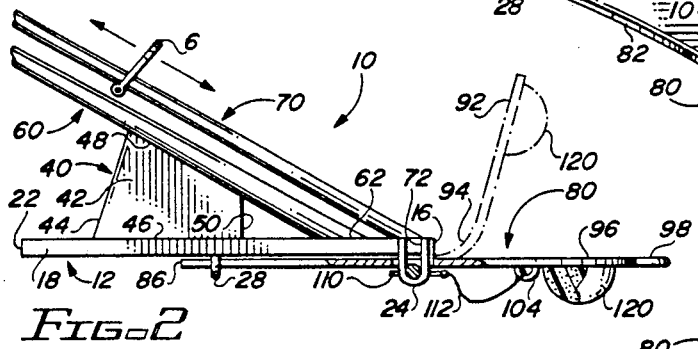
FIG. 2 is a side view of a portion of the apparatus of FIG. 1.
Figure 3:
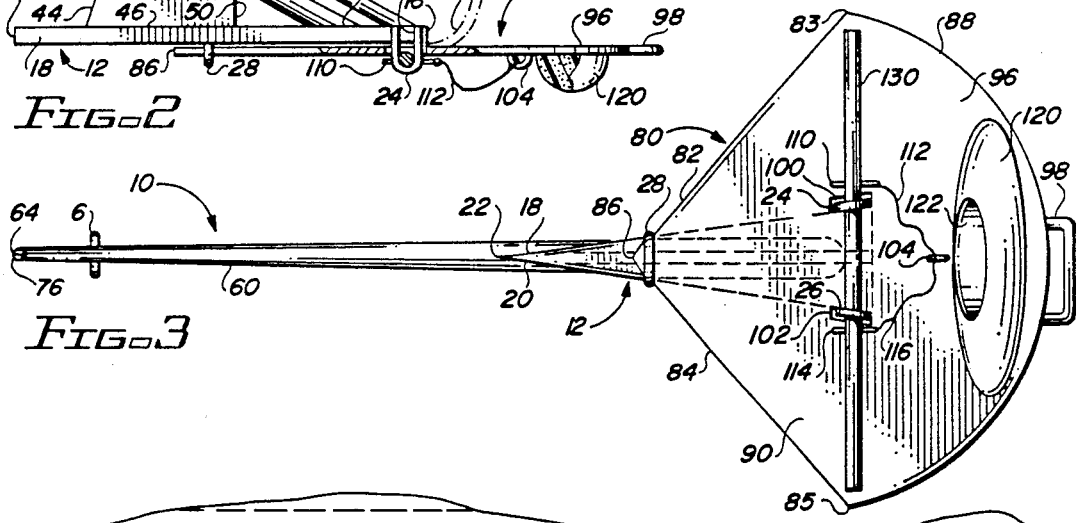
FIG. 3 is a bottom view of the apparatus of the present invention.

FIG. 2 is a side view of a portion of the anchor apparatus 10, including the fluke 12 and showing the wedge 40 and a portion of the shanks 60 and 70. FIG. 2 also illustrates the securing of the burying plate 80 to the fluke 12. FIG. 3 is a bottom view of the anchor apparatus 10 illustrating in more detail the securing of the burying plate 80 to the fluke 12. For the following general discussion of the anchor apparatus 10, reference will primarily be made to FIGS. 1, 2, and 3.

The fluke 12 of the anchor apparatus 10, as indicated above, comprises a generally elongated and relatively narrow triangular plate having a top edge 16, a pair of side edges 18 and 20, and a point 22. The point 22 comprises the juncture of the side edges 18 and 20. The side edges 18 and 20 extend from the top edge 16 to the point 22. The top edge 16 comprises the base of an isosceles triangle.

For securing the burying plate 80 to the fluke 12, there is a pair of retainer elements 24 and 26 at the upper portion of the fluke 12 and a lower retainer 28 remote from the upper retainers. The lower retainer 28 is centrally located with respect to the fluke 12. The retainers 24, 26, and 28 extend downwardly from the bottom surface of the fluke 12.

The retainers 24 and 26 comprise generally U-shaped elements extending downwardly from the sides 18 and 20 of the fluke 12 adjacent to the top edge 16. The lower retainer 28 is also a generally U-shaped element, but it is slightly broader than the elements 24 and 26. It is symmetrically located with respect to the fluke 12 and connected across the fluke to the side edges 18 and 20, and spaced apart from the point 22, or rearwardly from the point 22. This is best shown in FIGS. 2 and 3.

The wedge 40 comprises a plate 42 appropriately secured, as by welding, to both the fluke 12 and the main shank 60. The wedge 40 includes a front edge 44 which is sharpened, to define a knife edge for cutting through seaweed, and the like.

The wedge 40 also includes a bottom edge 46 and a top edge 48. It is the bottom edge 46 that is disposed on the fluke 12, and it is the top edge 48 that is disposed against the main shank 60. The edges 46 and 48 are appropriately secured, as by welding, to the fluke 12 and main shank 60, respectively.

The wedge 40 also includes a rear edge 50 that extends between the bottom edge 46 and the top edge 48. The rear edge 50 is remote from the front edge 44. The wedge 40 is aligned with or disposed along the longitudinal axis of the fluke 12.

The wedge 40 provides two primary functions. The first function is to help secure the fluke 12 to the main shank 60. The wedge 40 is secured to both the fluke 12 and the shank 60 over a relatively long distance at or through the "front" of the fluke 12.

The second function is to provide the cutting edge 44 for cutting seaweed and the like as the anchor apparatus 10 moves downwardly toward and into the sea bottom. The phrase "seaweed and the like" refers to virtually all of the impediments the anchor apparatus 10 is likely to encounter on its way to the sea bottom, including various types of vegetation, coral, etc.

The main shank 60 is a relatively thick and tapered element which has an inner end 62 secured to the fluke 12 about midway between the sides 18 and 20 of the fluke 12 and spaced apart a predetermined distance from the top edge 16. The main shank includes an outer end 64 remote from the inner end 62. The main shank 60 is relatively strong so as to resist side loads imposed on the anchor apparatus 10 as by rocks, coral, and the like.

As indicated above, the main shank 60 is secured to both the fluke 12 and to the top edge 48 of the wedge 40. The wedge 40 is also secured to the fluke 12 along the bottom edge 46 of the wedge. The wedge 40, in this regard, acts as a gusset between the fluke 12 and the shank 60.

The retrieval shank 70 is disposed generally parallel to and above the main shank 60. It is much smaller than the main shank 60. It is preferably round and uniform in cross sectional configuration. The retrieval shank 70 includes an inner end 72 appropriately secured to the fluke 12 adjacent to the top edge 16.

The retrieval shank 70 extends outwardly above, and generally parallel to, the main shank 60. The retrieval shank 70 extends to an outer bent portion 74 adjacent to the outer end 64 of the main shank 60. The retrieval shank 70 terminates in an outer tip 76 on the bent portion 74. The outer tip 76 is appropriately secured, as by welding, to the outer edge 64 of the main shank 60.

A clevis 6 of an anchor chain 4 is disposed over the retrieval shank 70. The clevis 6, with the anchor chain 4 attached, moves conveniently and easily along the retrieval shank. This will be discussed in more detail below in conjunction with FIG. 4.

Figure 4:
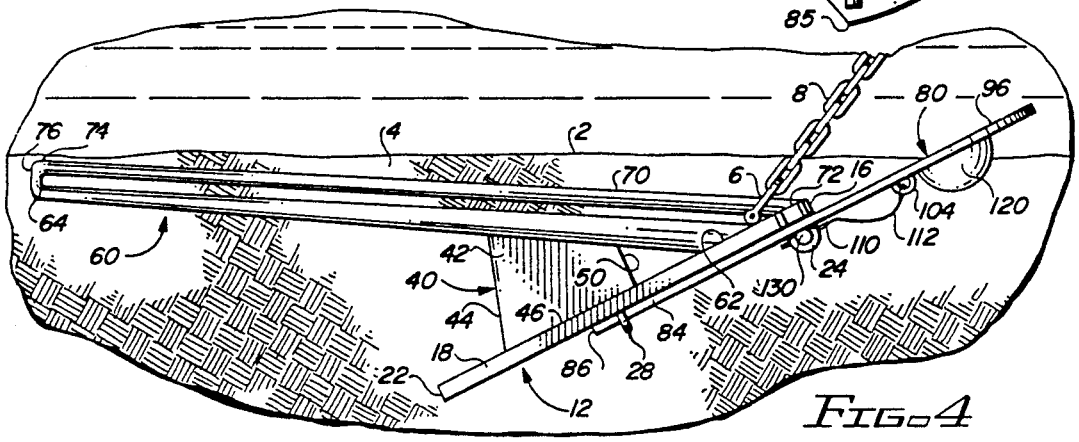
FIG. 4 is a side view of the apparatus of the present invention in a use environment.

The burying plate 80 is divided into two portions, a lower flat or planar portion 90, and an upper portion. Two upper portions are illustrated in FIGS. 1, 2, and 4 as a curved upper portion embodiment 92 and a planar upper portion embodiment 96.

In FIG. 1, the curved upper portion 92 embodiment is shown in solid line, with a flat or planer upper portion 96 embodiment illustrated in dotted line configuration. In FIG. 2, the curved upper portion 92 embodiment is shown in dotted line, and the planar upper portion 96 embodiment is shown in solid line. The flat or planar upper portion 96 is shown in both FIGS. 3 and 4.

The burying plate 80 includes a pair of sides 82 and 84 extending towards a bottom tip 86. The bottom tip 86 is disposed in the retainer 28. The retainer 28 extends downwardly from and across the fluke 12 to or between the sides 18 and 20. The burying plate 80 is secured to and disposed against the bottom of the fluke 12 by the tip 86 being disposed in the retainer 28 and by virtue of the retainers 24 and 28, as discussed below.

From the plate tip 86, the sides 82 and 84 extend outwardly at an obtuse angle. The side 82 extends outwardly to a tip 83, and the side 84 extends outwardly to a tip 85. Sides 82 and 84 may be sharpened to cut seaweed. Between the outer tips 83 and 85, a curved outer edge 88 extends arcuately. The arcuate outer or curved edge 88 has a generally constant radius.

Outwardly from a line drawn between the outer tips 83 and 85, there is a transitional area 94 between the lower front planar portion 90 and the curved upper portion 92 of the burying plate 80. This is shown best in FIGS. 1 and 2.

For the embodiment of the burying plate 80 in which the upper portion 96 is flat or planar, there is no transition area. In such, the entire burying plate 80 is flat or planar. This is best shown in FIGS. 2 and 4.

A handle 98 extends outwardly from the center of the outer curved edge 88. The handle 98 helps in the manual handling of the assembled anchor apparatus 10, and also helps in the manual handling of the burying plate 80 when the burying plate 80 is disassembled from the fluke 12.

A pair of apertures 100 and 102 extend through the burying plate 80 generally inwardly from the tips 83 and 85, respectively. The apertures or holes 100 and 102 receive the retainer elements 24 and 26 of the fluke 12. A stock 130 extends through the retainer elements 24 and 26 on the back or bottom side of the plate 80 to secure the burying plate 80 to the fluke 12.

An eye bolt 104 is appropriately secured to the back or bottom side of the upper portion, either 92 or 96, of the burying plate 80. The purpose of the eye bolt 104 is to allow a pair of lines 112 and 116 to be secured to the burying plate 80. The lines 112 and 116 may, of course, simply comprise two portions of a single line secured at about its center area to the eye bolt 104. The lines 112 and 116 are secured respectively to a pair of pins 110 and 114. The pins 110 and 114 extend through appropriate apertures in the stock 130 outboard from, and adjacent to, where the retainers 26 and 24 are disposed. The pins 110 and 114 appropriate secure the stock 130 in the retainers 26 and 24, respectively, to secure the fluke 12 and the burying plate 80 together. Removal of either pin 110 or 114 allows removal of the stock 130 and the detachment of the plate 80.

A float 120 is secured to the upper portion of the burying plate 80 adjacent to the handle 98 and generally centrally located with respect to the burying plate 80 at about the center or mid point of the curved outer edge 88. The float 120 is of light weight material, generally noncompressible. The float 120 serves to insure that the anchor apparatus 10 remains in a generally upright position, or with the upper portion of the burying plate 80 uppermost, as the anchor apparatus descends through the sea water and as the anchor apparatus reaches the sea bottom.

In FIG. 3, there is shown an alternate hand hold 122 in the float 120. The hand hold 122 is a concave depression in the float. The hand hold 122 is an alternate hand hold to the handle 98 to help aid in the manual handling of the anchor apparatus 10 or the plate 80.

The burying plate 80, disposed against the fluke 12, substantially increases the surface area of the anchor apparatus 10, or of the fluke 12 portion of the anchor apparatus 10, that extends into or penetrates into and is buried in a sea bottom. Essentially, the burying plate increases the surface area of the fluke 12 by several times to increase the holding power of the anchor apparatus 10 in a sea bottom.

FIG. 4 is a side view of the anchor apparatus 10 in its use environment, namely embedded in a sand floor of the surface of the sea bottom 2. The clevis 6 of an anchor chain 8 is shown disposed about the retrieval shank 70 adjacent to the upper or top edge 16 of the fluke 12 in the position of anchor retrieval. The fluke 12 and the burying plate 80 are shown extending beneath the bottom surface 2 at an acute angle. The float 120 of the burying plate 80 is shown disposed slightly above the bottom surface 2, but will bury with the plate. Both the main shank 60 and the retrieval shank 70 are disposed beneath the surface 2 and into the sand 4.

The weight of the anchor apparatus 10, plus the configuration of the fluke and burying plate, allows the anchor apparatus 10 to plow or extend into the sand 4 and thus firmly set itself as an anchor for the vessel to which the anchor chain 8 is attached. Moreover, it will be understood that the wedge 40 aids in the movement of the anchor apparatus 10, as through seaweed, rock, coral, and the like, to allow the anchor fluke 12 and the burying plate 80 to set themselves or the anchor either into the sea bottom 2 or firmly against rocks, coral, or the like.

It will be noted in FIG. 4 that the clevis 6 and the chain 8 is moved rearwardly from the position of the clevis 6 illustrated in FIG. 1. In FIG. 2, the clevis 6 is shown with large arrows indicating the movement upwardly or downwardly along the retrieval shank 70. In FIG. 4, the clevis 6, and the chain 8, is moved along the retrieval shank 70 to adjacent to the upper edge 16 of the fluke 12. In such a position, when it is desired to raise or weigh the anchor 10, the anchor 10 will be relatively easily moved upwardly, from its rearward area so that it will slip outwardly in about the same manner in which it plowed into the sand 4 of the sea bottom.

The rounded outer configuration of the burying plate 80 helps to insure that the anchor apparatus 10, as it is being raised from the sea bottom, moves easily through any rock formation, coral, or the like without getting caught or hanging up on a particular sea bottom element or in weeds, or the like. Any such impediment will move easily away from the anchor, or the anchor will move away from each such impediment, due to the rounded configuration of the plate 80 and to the location of the anchor chain 8.

In raising the anchor apparatus 10, with the anchor chain 8 as shown in FIG. 4, the anchor 10 will be drawn out of the seabed in the reverse direction. Then when raised, the weight concentrated on the fluke 12, the wedge 40, and the burying plate 80 causes the chain 8 to move upwardly on the retriever shank 70 to the outer bent portion 74 at the tip 76 and the outer end 64, as shown in FIG. 1.

What I claim is:

1. Anchor apparatus for anchoring a vessel to a sea bottom, comprising, in combination:

fluke means for penetrating into a sea bottom;

shank means secured to the fluke means and extending over the fluke means for securing the anchor apparatus to the vessel;

wedge means extending between the fluke means and the shank means for securing the fluke means to the shank means; and burying plate means secured to the fluke means for providing additional surface area for the fluke means and for extending into the sea bottom with the fluke means, including float means for helping the anchor apparatus to maintain a predetermined orientation as the anchor apparatus moves downwardly towards and into the sea bottom.

2. The apparatus of claim 1 in which the fluke means comprises a generally triangularly shaped element having a top edge and a point remote from the top edge for digging into the sea bottom.

3. The apparatus of claim 2 in which the shank means is secured to the fluke means adjacent to the top edge.

4. The apparatus of claim 1 in which the burying plate means is removably secured to the fluke means.

5. The apparatus of claim 1 in which the burying plate means includes a generally planar portion and a curved portion.

6. The apparatus of claim 1 in which the burying plate means include a first generally planar portion disposed against the fluke means and a second generally planar portion.

7. The apparatus of claim 1 in which the float means includes a handle for manually handling the anchor apparatus.

8. The apparatus of claim 1 in which the burying plate means includes a handle remote from the fluke means.

9. The apparatus of claim 1 in which the shank means includes a main shank and a retrieval shank.

10. The apparatus of claim 9 in which the main shank is secured to the fluke means and to the wedge means, and the retrieval shank is secured to the fluke means and to the main shank.

11. Anchor apparatus for anchoring a vessel to a sea bottom, comprising, in combination:

fluke means for penetrating into a sea bottom, including a generally triangular plate having a top edge and a point remote from the top edge, a first and a second retainer adjacent to the top edge and a third retainer disposed between the top edge and the point;

shank means secured to the fluke means and extending over the fluke means for securing the anchor apparatus to the vessel;

wedge means extending between the fluke means and the shank means for securing the fluke means to the shank means and for providing a cutting edge; and burying plate means disposed against and removably secured to the fluke means for providing additional surface area for the fluke means and for extending into the sea bottom with the fluke means, including a first and a second aperture for receiving the first and second retainers, respectively, of the fluke means, and a tip extending into the third retainer, for securing the burying plate means to the fluke means.

12. The apparatus of claim 11 in which the burying plate means further includes a stock extending through the first and second retainers for securing the burying plate means to the fluke means.

13. The apparatus of claim 12 in which the burying plate means further includes pin means for removably securing to stock in the first and second retainers.

14. Anchor apparatus for securing a vessel to a sea bottom, comprising, in combination:

fluke means, including a generally triangular plate having a top edge, a point remote from the top edge, and a pair of side edges extending between the top edge and the point;

wedge means secured to the fluke means, including a cutting edge for cutting seaweed and the like as the anchor apparatus moves from the vessel towards and into the sea bottom;

shank means, including a main shank secured to the wedge means and to the fluke means, and a retrieval shank secured to the fluke means and to the main shank; and burying plate means removably secured to the fluke means, including a lower planar portion disposed against the plate of the fluke means, and an upper portion extending outwardly from the lower planar portion.

15. The apparatus of claim 14 in which the burying plate means further includes a float secured to the upper portion.

16. The apparatus of claim 14 in which the upper portion of the burying plate means is generally planar and is a continuation of the lower planar portion.

17. The apparatus of claim 14 in which the upper portion of the burying plate means is curved.

* * * * *